US006657388B2

(12) United States Patent
Wijenberg et al.

(10) Patent No.: US 6,657,388 B2
(45) Date of Patent: Dec. 2, 2003

(54) HIGH-PRESSURE DISCHARGE LAMP

(75) Inventors: Christoffel Wijenberg, Eindhoven (NL); Antonius Ludovicus Johannes Cornelis Heijnen, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 09/836,087

(22) Filed: Apr. 17, 2001

(65) Prior Publication Data

US 2001/0043045 A1 Nov. 22, 2001

(30) Foreign Application Priority Data

Apr. 19, 2000 (EP) ..... 00201411

(51) Int. Cl.[7] ..... H01J 17/18; H01J 61/36
(52) U.S. Cl. ..... 313/623; 313/624; 313/625
(58) Field of Search ..... 313/623–625

(56) References Cited

U.S. PATENT DOCUMENTS

| | | | | | |
|---|---|---|---|---|---|
| 4,001,625 | A | * | 1/1977 | Schat et al. | 313/318.04 |
| 4,048,533 | A | | 9/1977 | Hinson et al. | 313/188 |
| 4,602,956 | A | | 7/1986 | Partlow et al. | 75/235 |
| 4,983,881 | A | | 1/1991 | Eliasson et al. | 313/607 |
| 5,404,078 | A | * | 4/1995 | Bunk et al. | 313/623 |
| 5,424,609 | A | * | 6/1995 | Geven et al. | 313/331 |
| 5,714,835 | A | | 2/1998 | Zachau et al. | 313/486 |
| 5,910,333 | A | | 6/1999 | Lin et al. | 427/69 |
| 5,998,939 | A | * | 12/1999 | Fellows et al. | 313/318.01 |

FOREIGN PATENT DOCUMENTS

| | | | | |
|---|---|---|---|---|
| EP | 0587238 A1 | | 3/1994 | H01J/61/36 |
| JP | 8319483 A | | 12/1996 | |
| JP | 2001068062 A | * | 3/2001 | H01J/61/073 |
| WO | 98/49715 | | 11/1998 | |
| WO | 00/58998 | | 10/2000 | |

* cited by examiner

*Primary Examiner*—Ashok Patel
*Assistant Examiner*—Anthony Perry
(74) *Attorney, Agent, or Firm*—Ernestine C. Bartlett

(57) ABSTRACT

The invention relates to a high-pressure discharge lamp which is provided with a discharge vessel which encloses a discharge space. The discharge vessel has a ceramic wall and is closed by a ceramic plug. An electrode which is located inside the discharge space is connected to an electric conductor by way of a leadthrough element. The leadthrough element projects through the ceramic plug with a close fit and is connected thereto in a gastight manner by way of a sealing ceramic. The leadthrough element has a first part which is formed by a cermet at the area of the gastight connection.

Figure 1:
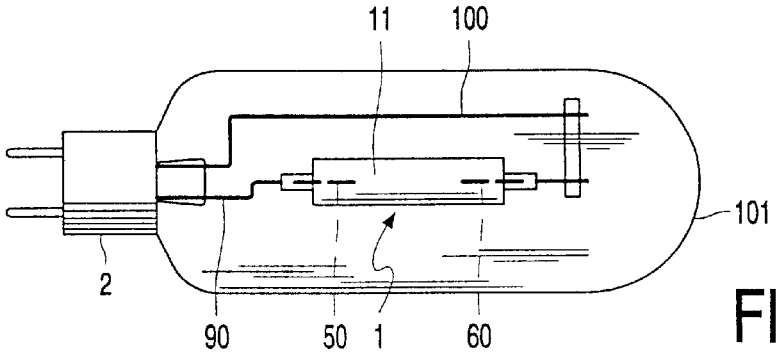

In accordance with the invention the leadthrough element has a second part which is a metal part which extends from the cermet in the direction of the electrode.

17 Claims, 1 Drawing Sheet

HIGH-PRESSURE DISCHARGE LAMP

The invention relates to a high-pressure discharge lamp which is provided with a discharge vessel that encloses a discharge space, has a ceramic wall and is closed by a ceramic plug, said discharge space accommodating an electrode which is connected to an electric current conductor by means of a leadthrough element which projects into the ceramic plug with a tight fit, is connected thereto in a gastight manner by means of a sealing ceramic and has a first part which forms a cermet at the area of the gastight connection.

A lamp of the kind set forth is known from U.S. Pat. No. 5,424,609 (=EP 0587238). The filling of the known lamp contains metal halide in addition to mercury.

In the context of the present description and the claims the term "ceramic wall" is to be understood to mean a wall of metal oxide, for example sapphire, sintered polycrystalline $Al_2O_3$ or YAG, as well as a wall of metal nitride, for example AIN.

The known lamp has a comparatively low power of 150 W at the most at an arc voltage of approximately 90 V. Because the electrode in such a lamp conducts comparatively small currents during operation of the lamp, the dimensions of the electrode may remain comparatively small so that a comparatively small internal diameter of the projecting plug suffices. In the case of a lamp having a rated power in excess of 150 W, or a substantially lower arc voltage, so in the case of large electrode currents, electrodes of larger dimensions are required. Consequently, the internal plug diameter will be larger accordingly. It has been found that in such lamps there is an increased risk of premature failure, for example due to breaking off of the electrode or cracking of the plug.

It is an object of the present invention to provide a way to mitigate said drawbacks.

To this end, a high-pressure discharge lamp of the kind set forth is characterized accordance with the invention in that the leadthrough element also includes a second part which is a metal part and extends from the cermet in the direction of the electrode.

It is an advantage of the lamp in accordance with the invention that surprisingly it has been found that an internal plug diameter of more than one millimeter can be used in the case of lamps that are suitable for larger electrode currents, and that premature failure of the lamp due to breaking off of the electrode or cracking of the plug is effectively counteracted. As a result of this construction of the leadthrough element the first part of the leadthrough element can be optimized in respect of the coefficient of expansion relative to the ceramic plug. To this end, the cermet preferably has a metal content of at the most 45% by volume, but preferably no more than 35% by volume. This is beneficial to the realization of a gastight connection that is capable of withstanding thermal shocks to a high degree. Because of the presence of the second, metal part of the leadthrough element the cermet is exposed to less high temperatures during operation of the lamp. Processes of attack, if any, will thus be delayed; this has a favorable effect on the service life of the lamp. The cermet is a sintered composition of a ceramic material and a metal. The metal of the cermet preferably corresponds to that of the metal part of the leadthrough element. This is beneficial to the realization of a solid connection between the cermet and the metal part of the leadthrough element. Metals that are suitable in this respect are preferably Mo and W, because each of these metals has a very high melting point and is capable of withstanding halogenide to a significant degree.

Figure 2:
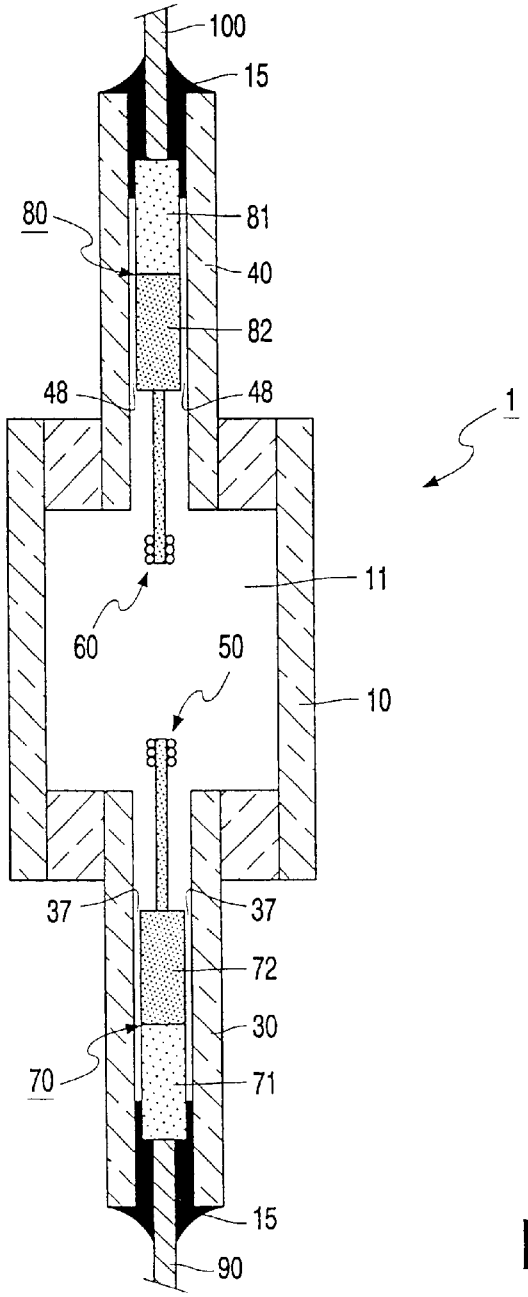

The above aspects and further aspects of the lamp in accordance with the invention will be described in detail hereinafter with reference to a drawing (not to scale). In the drawing:

FIG. 1 is a diagrammatic view of a lamp in accordance with the invention, and FIG. 2 is a detailed view of the discharge vessel of the lamp shown in FIG. 1.

FIG. 1 shows a high-pressure discharge lamp which includes a discharge vessel 1 which encloses a discharge space 11 and has a ceramic wall, said discharge space containing a filling that can be ionized. Two electrodes 50, 60 are arranged in the discharge space. The discharge vessel is enclosed by an outer bulb 101, one end of which is provided with a lamp base 2. A discharge occurs between the electrodes 50, 60 in the operating condition of the lamp. The electrode 50 is connected, via a current conductor 90, to a first electric contact which forms part of the lamp base 2. The electrode 60 is connected, via a current conductor 100, to a second electric contact which forms part of the lamp base 2. The discharge vessel, being shown in greater detail in FIG. 2 (not to scale), has a ceramic wall 10 and is sealed by a ceramic plug 30, 40. The discharge space 11 accommodates the electrode 50, 60 which is connected, by way of a leadthrough element 70, 80, to the electric current conductor 90, 100, said leadthrough element projecting into the ceramic plug 30, 40 with a tight fit 37, 48 and is connected thereto in a gastight manner by means of a sealing ceramic 15. At the area of the gastight connection the leadthrough element 70, 80 includes a first part 71, 81 which forms a cermet. The leadthrough element also includes a second part 72, 82 which is a metal part which extends from the cermet in the direction of the electrode 50, 60.

A practical embodiment of a lamp in accordance with the invention as described above has a rated power of 400 W. Each of the electrodes consists of a tungsten bar of a diameter of 0.7 mm, one free end of which is provided with an electrode winding. The electrode is connected to a molybdenum rod which constitutes the second part of the leadthrough element. The Mo rod has a diameter of 1.45 mm. A first part of the leadthrough element, being formed by an $Al_2O_3$ Mo cermet with 35% Mo by weight, is connected to the Mo rod. The cermet also has a diameter of 1.45 mm. The cermet is connected to an Nb rod having a diameter of 1 mm. The Nb rod constitutes the electric current conductor. The electrode, the first part and the second part of the leadthrough element all have a length of 7 mm. The ceramic plug has an internal diameter of 1.50 mm.

The filling of the discharge vessel includes 50 mg Hg, 20 mg metal halide in a ratio of 83% mol NaI, 9.8 mol % TlI and 7.2 mol % $DyI_3$. The discharge vessel also contains Ar under a pressure of 30 kPa in the cold condition of the lamp.

The lamp was subjected to an endurance test which consisted partly of continuous operation of the lamp and partly of a test during which the lamp was periodically switched on and off. After a continuous period of operation of 11,000 hours, the lamp was still in good condition; no cracking of one of the projecting plugs had occurred and attack had occurred to a very minor extent only at the area of the cermet in each of the leadthrough elements. It was found that the lamp and the leadthrough elements were still in good condition after a switching endurance test during which the lamp was switched on and off 300 times in a period of 3000 hours.

What is claimed is:

1. A high-pressure discharge lamp including a discharge vessel that encloses a discharge space, said discharge vessel comprising:

a ceramic wall;

a ceramic plug closing said discharge space;

an electrode connected to an electric current conductor by a leadthrough element projecting into the ceramic plug with a tight fit thereto; and a sealing ceramic for sealing the ceramic plug in a gastight manner, wherein the leadthrough element is comprised of:

a first part which forms a cermet at the area of the gastight connection, and a second part which is a metal part and extends from the cermet in the direction of the electrode, the second part being of sufficient length so as to space the first part from the electrode thereby substantially reducing a heat exposure of the first part from the electrode, and wherein the first part and the second part are of substantially the same length.

2. A lamp as claimed in claim 1, wherein the electrode includes an electrode rod which is connected to the metal part of the leadthrough element.

3. A lamp as claimed in claim 1, wherein the cermet has a metal content of at the most 45% by volume.

4. A lamp as claimed in claim 3, wherein the cermet has a metal content of no more than 35% by volume.

5. A lamp as claimed in claim 1, wherein the metal of the cermet corresponds to that of the metal part of the leadthrough element.

6. A lamp as claimed in claim 1, wherein the metal part comprises at least one of Mo, W, and an alloy of the two.

7. A lamp as claimed in claim 6, wherein the metal part comprises W.

8. A lamp as claimed in claim 6, wherein the metal part comprises Mo.

9. A lamp as claimed in claim 6, wherein the metal part comprises an alloy of Mo and W.

10. A lamp as claimed in claim 1, wherein the leadthrough element is provided completely within the ceramic plug.

11. A lamp as claimed in claim 1, wherein the first part and the second part of the leadthrough element are sintered together.

12. A lamp as claimed in claim 1, wherein the first part substantially conforms to an inner volume of the ceramic plug to form a tight fit therewith.

13. A lamp as claimed in claim 1, wherein the second part substantially conforms to an inner volume of the ceramic plug to form a tight fit therewith.

14. A lamp as claimed in claim 1, wherein both the first part and the second part substantially conforms to an inner volume of the ceramic plug to form a tight fit therewith.

15. A lamp as defined in claim 1 , wherein the first part and the second part each have a length of about 7 mm.

16. A lamp as defined in claim 1, wherein the first part has a length of about 7 mm.

17. A high-pressure discharge lamp, including a discharge vessel that encloses a discharge space, said discharge vessel comprising:

a ceramic wall;

a ceramic plug closing said discharge space;

an electrode connected to an electric current conductor by a leadthrough element projecting into the ceramic plug with a tight fit thereto; and a sealing ceramic for sealing the ceramic plug in a gastight manner, wherein the leadthrough element is comprised of:

a first part which forms a cermet at the area of the gastight connection, and a second part which is a metal part and extends from the cermet in the direction of the electrode, the second part being of sufficient length so as to space the first part from the electrode thereby substantially reducing a heat exposure of the first part from the electrode, and wherein the second part has a length of about 7 mm.

* * * * *